United States Patent [19]

Virtanen

[11] Patent Number: 4,964,731

[45] Date of Patent: Oct. 23, 1990

[54] SHOTCRETE GUN

[75] Inventor: Olli Virtanen, Parainen, Finland

[73] Assignee: Oy Lohja AB, Finland

[21] Appl. No.: 189,752

[22] Filed: May 3, 1988

[30] Foreign Application Priority Data

May 21, 1987 [FI] Finland ..... 872246

[51] Int. Cl.[5] ..... B01F 13/02

[52] U.S. Cl. ..... 366/11; 366/13; 366/26; 366/50; 366/196; 239/210; 239/264; 118/323

[58] Field of Search ..... 366/1, 10, 3, 5, 11, 366/13, 26, 41, 42, 50, 186, 194–196, 27, 18; 239/210, 264, 265, 750, 751; 118/323

[56] References Cited

U.S. PATENT DOCUMENTS

| | | | |
|---|---|---|---|
| 998,762 | 7/1911 | Faller | 366/11 |
| 1,776,100 | 9/1930 | Blatt | 239/265 |
| 1,953,091 | 4/1934 | Westberg et al. | 366/11 |
| 1,954,005 | 4/1934 | Westberg et al. | 366/11 |
| 2,394,561 | 2/1946 | Parkhurst | 366/13 |
| 2,565,696 | 8/1951 | Moller et al. | 366/11 |
| 2,577,664 | 12/1951 | Pro | 366/11 |
| 2,964,302 | 12/1960 | Tombu | 366/11 |
| 3,156,452 | 11/1964 | Touzalin et al. | 366/147 |
| 3,227,426 | 1/1966 | Williams | 366/51 |
| 3,276,695 | 10/1966 | Giardino et al. | 239/265 |
| 3,351,289 | 11/1967 | Demaison | 239/750 X |
| 3,356,350 | 12/1967 | Burr et al. | 366/285 |
| 3,871,583 | 3/1975 | Kellert | 366/11 |
| 4,125,035 | 11/1978 | Dooley | 239/264 |
| 4,298,288 | 11/1981 | Weisbrod | 366/11 |

FOREIGN PATENT DOCUMENTS

| | | |
|---|---|---|
| 2041639 | 2/1972 | Fed. Rep. of Germany . |
| 2748742 | 8/1978 | Fed. Rep. of Germany . |
| 1297345 | 5/1961 | France . |
| 2370841 | 6/1978 | France . |
| 8302475 | 7/1983 | PCT Int'l Appl. . |
| 2098264A | 11/1982 | United Kingdom . |

*Primary Examiner*—Frankie L. Stinson

*Attorney, Agent, or Firm*—Kane, Dalsimer, Sullivan, Kurucz, Levey, Eisele and Richard

[57] ABSTRACT

Shotcrete gun consisting of a concrete container and a spraying device, such as a worm screw, and a nozzle for pressurized air. The whole shotcrete gun assembly is mounted on a traversing mechanism allowing the shotcrete gun to be shifted in the horizontal, vertical and depthwise directions beside the element to be shotcreted.

2 Claims, 3 Drawing Sheets

SHOTCRETE GUN

The present invention relates to a shotcrete gun consisting of a concrete container and a spraying device, such as a worm screw, and a nozzle for pressurized air.

All previously known shotcrete guns use transfer pipelines to bring the fresh concrete to the target. Therefore, the fresh concrete has to be loose and fluid.

The object of the present invention is to create a new type of shotcrete gun. The whole shotcrete gun of the invention is characterized in that the shotcrete gun assembly is mounted on a traversing mechanism allowing the shotcrete gun to be shifted in the horizontal, vertical and depthwise directions beside the element to be shotcreted. This minimizes the distance between the container and the nozzle, which means that less power is needed to transfer the fresh concrete from the container through the worm to the nozzle, so that very stiff fresh concrete can be sprayed directly onto the target, e.g. a wall element hanging in an upright position, ensuring that the concrete will readily stick to the target. The concrete surface can be cut and worked immediately to give the element the desired appearance. The shotcrete gun assembly can be easily moved beside the wall element in different directions.

A preferred embodiment of the invention is characterized in that the concrete container is detachably mounted on the shotcrete gun. Thus, when the container runs out of concrete, it can be quickly replaced with a filled one. In this way, the shotcreting can be performed without excessive breaks.

Another preferred embodiment of the invention is characterized in that the shotcrete gun is provided with a concrete mixer, which is mounted on a telescopic arm allowing it to be lifted out of the concrete container when the container is replaced. The relatively stiff fresh concrete, being continuously stirred by the mixer, is thus prevented from hardening in the container. The mixer can be quickly lifted up when the container is changed.

In the following, the invention is described by the aid of an example, reference being made to the drawings attached, wherein:

FIG. 1 is a side view of the shotcrete gun, placed at the side of an element.

FIG. 2. represents the replacement of the concrete container.

Figure 1:
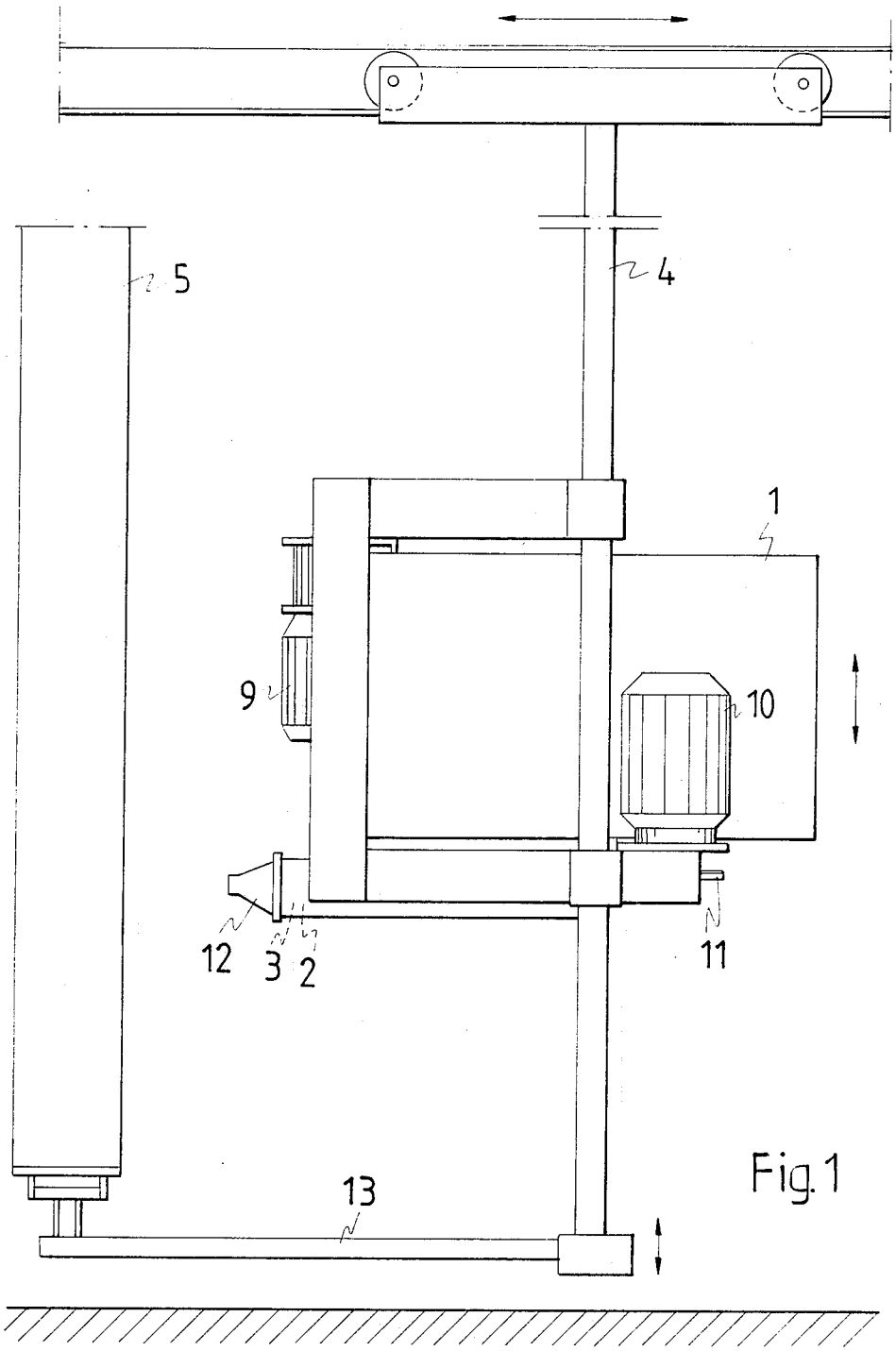
Figure 2:
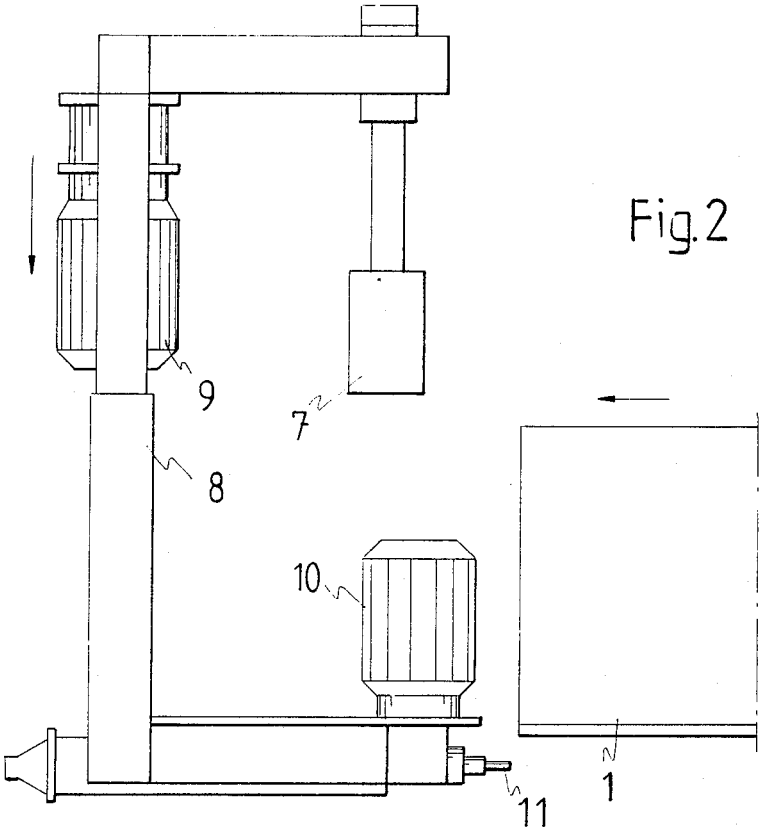
Figure 3:
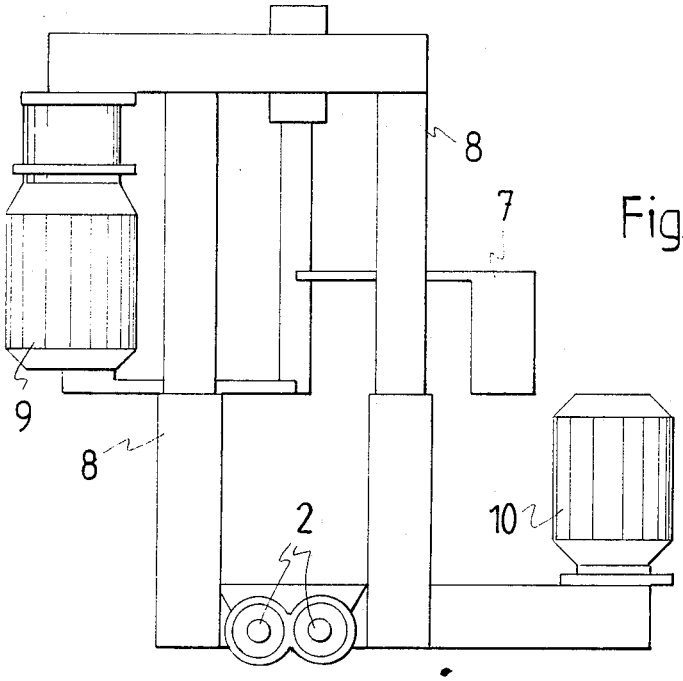
FIG. 3 is a front view of the shotcrete gun in FIG. 1
Figure 4:
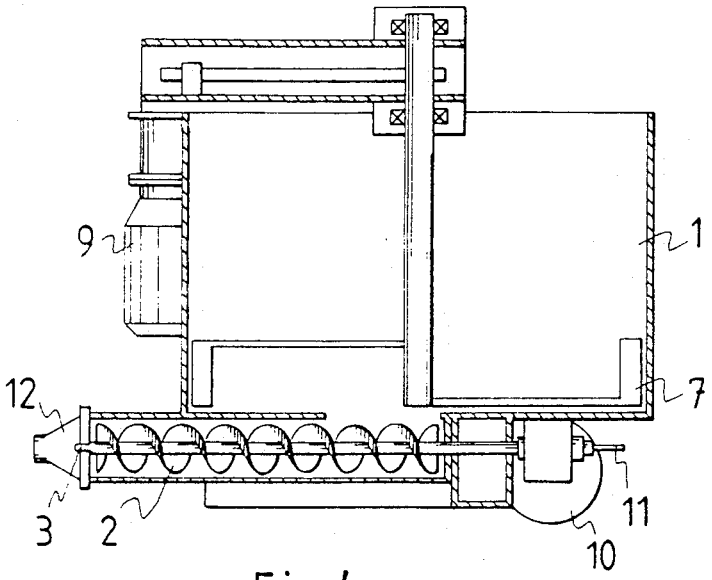
FIGS. 4 and 5 represent another embodiment of the shotcrete gun.
Figure 5:
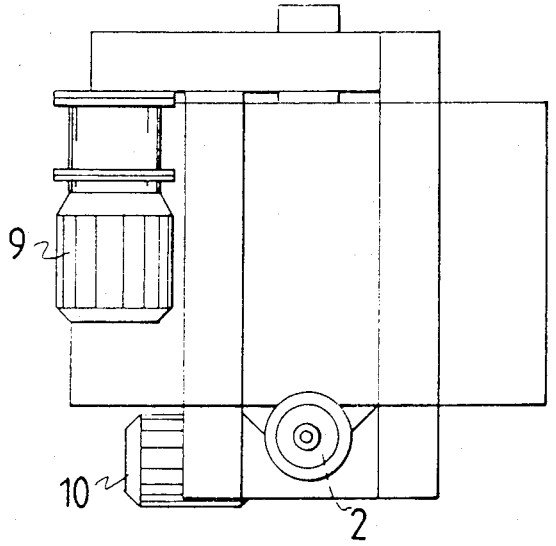

The shotcrete gun consists of a concrete container 1 and a spraying device, e.g.a worm screw 2, and a nozzle 3 for pressurized air. The whole shotcrete gun assembly is mounted on a traversing mechanism 4 allowing the shotcrete gun to be shifted in the horizontal, vertical and depthwise directions beside the element 5 to be shotcreted. As shown in FIGS. 2 and 3, the concrete container 1 is detachably mounted on the shotcrete gun. The bottom of the container 1 is provided with a hatch which can be slid sideways when the container 1 is in place above the feed screws 2. The shotcrete gun maY use two feed screws, as shown in FIG. 3, or only one feed screw, as shown in FIG. 5. The shotcrete gun is provided with a concrete mixer 7, which is mounted on a telescopic arm 8 allowing it to be lifted out of the concrete container 1 to permit change of containers. The apparatus has two motors 9 and 10, motor 9 driving the mixer 7 and motor 10 the feed screws 2. The concrete is sprayed out through the nozzle 12 onto the element 5 by blasting pressurized air through the pipe 11. The shotcrete gun and the element may be connected with a holding boom 13 to keep them steady.

I claim:

1. A shotcrete gun assembly for applying a coating of fresh concrete onto a target, said shotcrete gun assembly comprising:

a shotcrete gun, said shotcrete gun including a cylindrical pipe having a first end, a second end, a side wall, and a longitudinal axis; a worm screw within said cylindrical pipe, said worm screw being rotatable about a tube aligned with said longitudinal axis of said cylindrical pipe and extending at least from said first end o said second end thereof, said worm screw having an axis in common with said longitudinal axis of said cylindrical pipe, said tube serving as a conduit for compressed air through said cylindrical pipe from said first end to said second end thereof; a first opening through said side wall of said cylindrical pipe for the introduction of said concrete into said cylindrical pipe; a nozzle at said second end of said cylindrical pipe, said nozzle having an orifice through which said compressed air expels said concrete toward said target; means for supplying compressed air to said tube; and means for rotating said worm screw;

a frame, said shotcrete gun being mounted on said frame with said nozzle of said shotcrete gun being oriented toward said target; and a shotcrete container mounted on said frame, said shotcrete container having an opening through which said concrete moves into said first opening through said side wall of said cylindrical pipe of said shotcrete gun.

2. A shotcrete gun assembly as claimed in claim 1 further comprising:

a traversing mechanism, said frame being mounted on said traversing mechanism, said traversing mechanism having a vertical member so that said shotcrete gun can be shifted in a vertical direction; said traversing mechanism further having a first horizontal member, said shotcrete gun being slidable on said first horizontal member so that said shotcrete gun can be shifted depthwise relative to said target; and said traversing mechanism further having a second horizontal member, said shotcrete gun being slidable on said second horizontal member so that said shotcrete gun can be shifted in a horizontal direction.

* * * * *